US010329786B2

(12) United States Patent
Valli

(10) Patent No.: US 10,329,786 B2
(45) Date of Patent: Jun. 25, 2019

(54) TRANSFERRING CARRIAGE OF VEHICLES FOR AN AUTOMATIC MECHANIC PARKING SYSTEM

(71) Applicant: SOTEFIN PATENTS SA, Lugano (CH)

(72) Inventor: Giovanni Valli, Cantello-Varese (IT)

(73) Assignee: SOTEFIN PATENTS SA, Lugano (CH)

( * ) Notice: Subject to any disclaimer, the term of this patent is extended or adjusted under 35 U.S.C. 154(b) by 0 days.

(21) Appl. No.: 15/311,898

(22) PCT Filed: May 19, 2015

(86) PCT No.: PCT/IB2015/053673
§ 371 (c)(1),
(2) Date: Nov. 17, 2016

(87) PCT Pub. No.: WO2015/177718
PCT Pub. Date: Nov. 26, 2015

(65) Prior Publication Data

US 2017/0089087 A1 Mar. 30, 2017

(30) Foreign Application Priority Data

May 21, 2014 (IT) ..... RM2014A0258

(51) Int. Cl.
*E04H 6/42* (2006.01)
*E04H 6/22* (2006.01)
(Continued)

(52) U.S. Cl.
CPC ..... *E04H 6/22* (2013.01); *E04H 6/182* (2013.01); *E04H 6/183* (2013.01); *E04H 6/305* (2013.01); *E04H 6/424* (2013.01)

(58) Field of Classification Search
CPC ..... E04H 6/424; E04H 6/182; E04H 6/483; E04H 6/186; E04H 6/245
(Continued)

(56) References Cited

U.S. PATENT DOCUMENTS 825,213 A 7/1906 Hervieu et al.
2,851,961 A * 9/1958 Billings ..... E04H 6/183 104/50
(Continued)

FOREIGN PATENT DOCUMENTS

DE 19842084 A1 3/2000

OTHER PUBLICATIONS

Robert Decker (Authorized Officer), International Search Report dated Sep. 16, 2015, International Application No. PCT/IB2015/053673, pp. 1-2.

*Primary Examiner* — Mark C Hageman
(74) *Attorney, Agent, or Firm* — MH2 Technology Law Group LLP

(57) ABSTRACT

Transferring carriage (100) of vehicles for automatic mechanic parking systems comprising at least a frame (1); means of handling of said carriage (100); and at least a device (13) of centering, raising and keeping up of the wheel (32) of a vehicle, said device (13) comprising at least a couple of clamp elements (17) and at least a movable support (14); each couple of clamp elements (17) being supported by said movable support (14); said movable support (14) being transversally translatable for positioning said clamp elements (17) of a same couple in proximity of a wheel (32) of an axle of a vehicle such that the centering, raising and keeping up of the two wheels (32) of an axle of a vehicle is achieved by means of a single transversal
(Continued)

movement towards outside of the carriage of said at least one movable support (14) and of the couple of clamp elements (17) integral therewith.

15 Claims, 6 Drawing Sheets

(51) Int. Cl.
*E04H 6/18* (2006.01)
*E04H 6/30* (2006.01)

(58) Field of Classification Search
USPC ..... 414/256, 255, 260, 259, 429
See application file for complete search history.

(56) References Cited

U.S. PATENT DOCUMENTS

| | | | | |
|---|---|---|---|---|
| 3,435,965 | A | 4/1969 | Scharf et al. | |
| 4,968,208 | A * | 11/1990 | Friberg | E04H 6/183 414/256 |
| 7,997,848 | B2 * | 8/2011 | Valli | E04H 6/186 414/253 |
| 2003/0123959 | A1 * | 7/2003 | Lee | E04H 6/183 414/234 |

* cited by examiner

TRANSFERRING CARRIAGE OF VEHICLES FOR AN AUTOMATIC MECHANIC PARKING SYSTEM

CROSS REFERENCE TO RELATED APPLICATIONS

This application is a U.S. National Stage application of PCT/IB2015/053673, filed May 19, 2015, which claims priority to Italian Application No. RM2014A000258, filed May 21, 2014, the contents of all of which are hereby incorporated by reference in their entirety.

FIELD OF THE INVENTION

The present invention concerns the field of the automatic mechanic parking systems. In detail, the present invention concerns a vehicles transferring carriage for a mechanic automatic parking system.

BACKGROUND ART

In the mechanic automatic parking systems, the vehicles are left by the user in an entrance/exit room and from here automatically moved in the parking place time by time assigned, by means of transferring devices.

It is known in said parking systems to have a vehicles transferring device, generally composed by one or two transferring carriages, onto which the car to bed or to be extracted from the parking is loaded. The transferring carriage is normally positioned on a vertically and/or horizontally translating platform through which it can be moved into the required position, on the same level or on different levels of the parking.

From said position, the carriage is capable of transferring the vehicle, bringing it from the platform it finds itself to another position, on another translating platform, in the exit rooms or in the park places, as well as it is able to transfer the vehicle by bringing it from another place, on different translating platforms, in the entering rooms or in the park places, for positioning it on the platform onto which it finds itself. The cyclic movement is always of a back and forth type, in the sense that it moves from its platform up to another position for taking or leaving a vehicle for then coming back to the platform with or without the vehicle.

The following documents describe some known automatic mechanic parking systems: U.S. Pat. No. 4,968,208, KR 100696296, EP 1373666, KR100622553.

The applicant has observed that the known carriages, generally, do not realize the centering, taking and raising of the wheels of the car with a single device, thereby resulting complex and expensive to produce.

The document DE 198 42 084 (Stolzer) shows a transferring carriage comprising a frame, means of handling of said carriage and some devices for taking, raising and centering the wheels of a vehicle, wherein the respective movements are realized in different times and with a plurality of devices. In particular, while the taking and the raising of the wheels of the vehicle are realized by the transversal motion of the slides (26) and rotatory of the grippers (28) (29), the centering of the wheels takes place subsequently by means of an alignment of a central support (30) with respect to the longitudinal axis of the transferring carriage. This causes a dilation of the times of centering vehicle and necessitates of a plurality of different actuators.

Furthermore, document DE 198 42 084 shows a transferring carriage (20) suitable for sliding in a trench (18) existing between the supporting wedges (11) of the wheels of the vehicle. The devices for the taking and the raising of the wheels of the vehicle are positioned over the frame (21) of the carriage (20) for avoiding colliding, during their transversal motion, with said frame (21). From this derives a complexity and size of the transferring carriage shown in the aforementioned document due to which this last could not pass under the vehicle if said trench was not present. Consequently, its use requires realizing particular building constructions.

Furthermore, the applicant has noticed that the carriages for known mechanical parking systems do not allow centering, taking and raising the wheels of the car with a single movement that is continuous and composed by means of a single device.

The applicant has, furthermore, noticed that the carriages for known systems of mechanic parking do not allow to reduce satisfactorily the volume that is required for storing vehicles in the automatic mechanic parking systems.

SUMMARY OF THE INVENTION

According to the present invention, it is therefore realized a transferring carriage of vehicles for automatic mechanic parking systems comprising:

- at least a frame;
- means of handling of said carriage; and
- at least a device of centering, raising and keeping of the wheel of a vehicle;
- said device comprises at least a couple of clamp elements and at least a movable support; each couple of clamp elements being supported by said movable support;
- said movable support being transversally translatable for positioning said clamp elements of a same couple in proximity of a wheel of an axle of a vehicle;
- said transferring carriage being characterized in that the device of centering, raising and keeping of the wheel of a vehicle is shaped for performing, the centering, the raising and the keeping of the two wheels of an axle of a vehicle by means of a single transversal movement towards outside of the carriage of the movable supports and of the couples of clamp elements integral therewith.

The applicant considers that not only the width necessary to the recovery of a vehicle is minimized by the automatic centering, but also the height that is necessary to the recovery of the vehicle is minimized thanks to the low thickness of the carriage according to the invention. The carriage according to the present invention can be, in fact, inserted below the vehicle without raising this last with respect to the sliding plane of the carriage itself. Another advantage is constituted by the simplicity of the carriage that by performing the centering, taking and raising of the wheels with a single devices, results lights and economic.

In the context of the present invention:

- For "longitudinal direction" or "longitudinally" it is intended a direction generically directed to the sense of motion of the driving wheels of the carriage.
- For "transversal direction" or "transversally" it is intended a direction or in an orthogonal direction with respect to the longitudinal axis of the carriage.
- For counter inclined with reference to two inclined planes, it is intended that the two planes present with respect to an axis interposed between them the same inclination in absolute value, but with an opposite sign.
- For "composed movement" it is intended a movement of a plurality of parts of the transferring carriage object of the present invention, being performed in substantial continuous temporal sequence. In details it refers to the transversal movement of the movable supports and the rotation movement of the couples of clamp elements thereto integral which are operated by a single transversal movement of the device (13) of centering, raising and keeping of the wheel.

The present invention, in the aforementioned aspect, it can present at least one of the preferred features that are hereinafter described.

Preferably, the frame can comprise at least two movable supports, counterposed with respect to a longitudinal axis of the carriage; the movable supports being translating with respect to the longitudinal axis of the carriage between a resting closed position and a open working position, said open position being transversally arranged more externally with respect to said closed position.

Conveniently, the open position changes according of the vehicle to be transported.

Preferably, the open position changes according to the transversal distance inside the tires of the wheels of an axle of the vehicle to be transported.

Conveniently, the open position is such that once the vehicle is centered, the longitudinal axis (X-X) of the carriage coincides with the longitudinal axis of the vehicle to be transported. Advantageously, the clamp elements of each couple are opposed with respect to a transversal direction Y-Y of said carriage and being rotatable around a rotation axis between a resting position and a closure position wherein they are disposed substantially faced one to the other.

Preferably, each clamp element comprises:

at least an arm comprising at least a inclined plane; said at least a arm being pivoting between an open position and a closed position substantially orthogonal to the longitudinal axis of the carriage.

at least a lip functionally connected to said at least a arm and shaped so as to when being pressed against a tyre of a wheel of a vehicle, tends to rotate the arm from said open position towards said closed position. Conveniently, each arm comprises a plurality of rollers arranged on said inclined plane; the inclined planes two clamp elements of the same couple being counter inclined, when said arms are in said closure position.

Advantageously, the carriage can comprise a translation group of said movable support comprising:

at least a worm screw;

at least a geared motor operatively connected to said at least a worm screw for driving its rotation; and at least a pulling anchor.

Preferably, each pulling anchor comprises:

at least a cross head nut in coupling with said worm screw; and at least a quill provided with a crossbeam at whose ends two pushing rods are hinged.

Advantageously, each pushing rod is hinged to an end of a said clamp element so as to the axis of each pushing rod passes for the rotation axis of each clamp element when the clamp elements of each couple are in resting position.

Preferably, the carriage comprises two worm screws rotationally actuated by said geared motor; of said two worm screws a first presenting a right-handed threading, while to other presenting a left-handed threading; the inverse rotation of the two worm screws axially moves the two pushing anchors towards outside or towards inside of the carriage.

Conveniently, the frame comprises at least a crossbeam wherein a movable supporting element can slide.

Preferably, each movable supporting element comprises two tines externally arranged with respect to a crossbeam, each prong sliding in a crossbeam of the frame.

According to another aspect, the present invention concerns a vehicles transferring device for automatic mechanic parking systems comprising two transferring carriages as previously described, arranged one following the other in longitudinal direction and eventually coupled.

Advantageously, the device of centering, raising and keeping of the wheel lies on a same horizontal plane, fundamentally coinciding with the one of the frame of the carriage.

According to the present invention it is furthermore realized a method of handling of a vehicle in an automatic mechanic parking, said method comprising:

a step of electronic command of the handling of a couple of transferring carriages of vehicles for systems of automatic mechanic parking along a longitudinal axis wherein said couple of transferring carriages is stopped when devices of centering, raising and keeping of the wheel of a vehicle, said devices being part of said transferring carriage, are in correspondence of a couple of opposed wheels a same axle of the vehicle;

a subsequent step of electronic command of a motion of movable supports of said transferring carriage along a direction which is transversal with respect to said longitudinal axis, said movable supports housing said device of centering;

wherein when exerting a reaction force of the wheel of the vehicle against said device of centering, said device of centering automatically actuates clamp elements which are installed on said movable support and that perform simultaneously a taking and a raising of the wheel, maintaining said couple of transferring carriages axially aligned on said longitudinal axis.

In an aspect of the present invention, said step of electronic command of the motion of said movable supports comprises a step of simultaneous motion of two opposed centering devices.

Furthermore, said method comprises a step of transmission of a stopping signal to a data processing unit supervising said electronic commands of motion of said couple of carriages; said stopping signal coming from position sensing means and causing the automatic activation of the electronic command of activation of said movable supports.

Advantageously, finally, said movable supports push said counterposed centering devices in a symmetrical way.

BRIEF DESCRIPTION OF THE DRAWINGS

Further features and advantages of the invention will be clearer from the detailed description of some preferred and not exclusive embodiments of a new transferring carriage of vehicles for systems of automatic mechanic parking according to the present invention.

Said description will be hereinafter exposed referring to attached drawings, provided only for exemplificative and therefore non-limiting extent, wherein.

DETAILED DESCRIPTION OF THE EMBODIMENTS OF THE INVENTION

Figure 1:
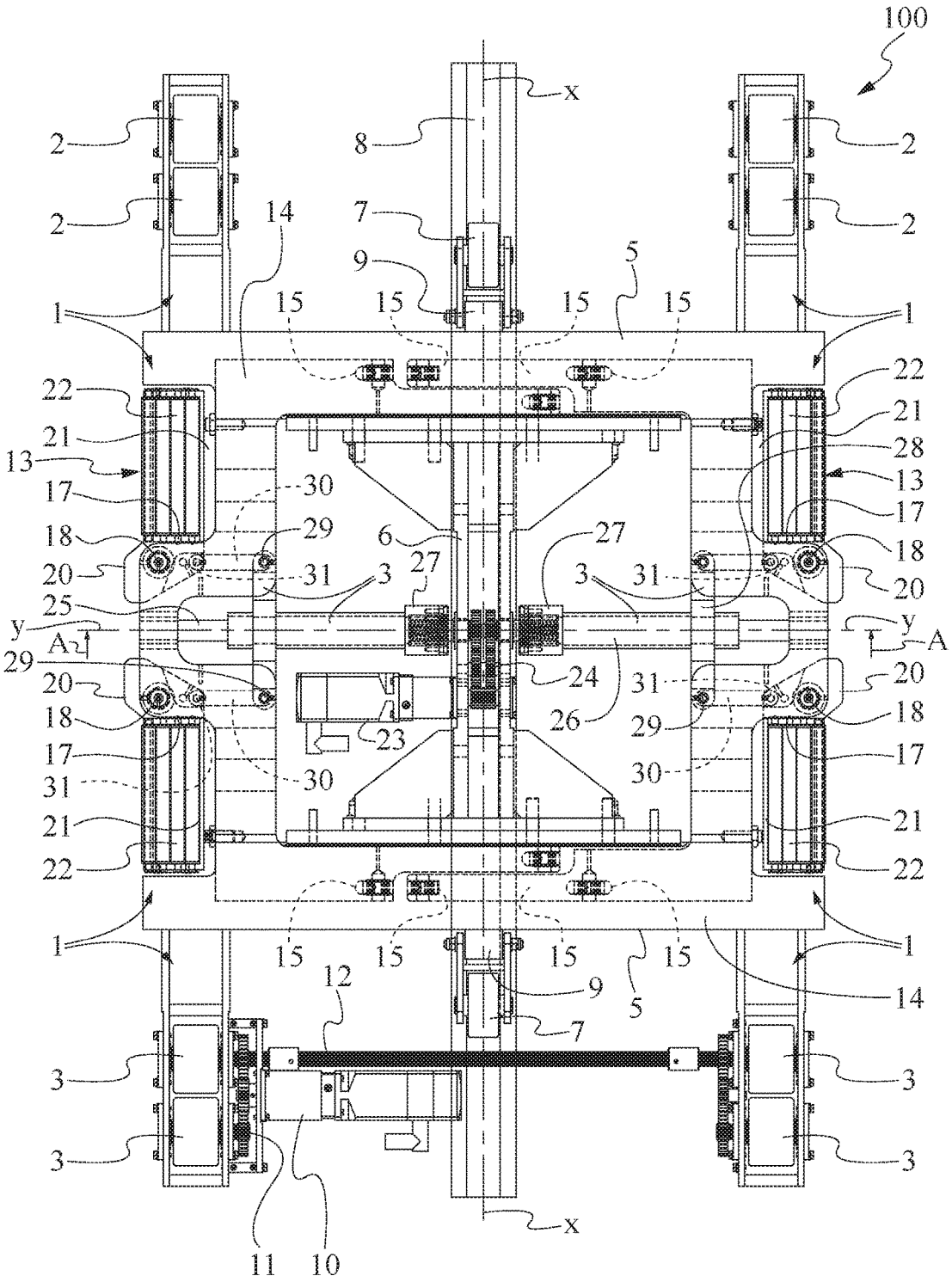
FIG. 1 is a schematic view from above of a transferring carriage for systems of automatic mechanic parking according to the present invention, in a first position with the movable supports retracted and the clamp elements in an open position.

Referring to FIGS. 1-9, a transferring carriage of vehicles for systems of automatic mechanic parking according to the present invention, is identified with the reference numeral 100.

Referring to the embodiment shown in the figures the carriage is constituted by a frame 1 provided with supporting free wheels 2 and driving 3 suitable for sliding on a planar surface a surface 4, like the upper surface of a platform of vertical translation and/or horizontal translation of the car parking place.

The free wheels 2 and driving 3 sustain the frame 1 that preferably presents two crossbeams 5 jointed by a central linking 6.

On the two crossbeams 5 are fixed two wheels 7 that drive the transferring carriage in its translation motion.

Preferably, the wheels 7 slide in a rectilinear channel 8 which is fixed to the planar surface 4 of the position of parking.

Preferably, the driving wheels 7 are elastically fixed to the crossbeams 5 by means of angular springs 9. The frame 1 is moved from a first geared motor 10 that through the pinions 11 and the shaft 12 transmits the motion to the driving wheels 3.

A centering, taking and raising device 13 of two wheels of an axle of the vehicle is housed on the frame 1. On the frame 1, the devices of centering 13 are arranged two by two opposed one with respect to the other.

Referring to embodiment shown in the figures, said device 13 of centering, taking or keeping and raising is composed by two movable supports 14 and by two couples of clamp elements 17, a couple for each movable support 14.

Each movable support 14 is preferably U shaped and comprises two tines 34 externally arranged with respect to a crossbeam 35, each prong 34 can slide in a crossbeam 5 of the frame 1.

The tines 34 of each movable support 14, can transversally slide into the crossbeams 5 by means roller wheels 15 which are guided on particular notches obtained in the crossbeams 5.

Figure 2:
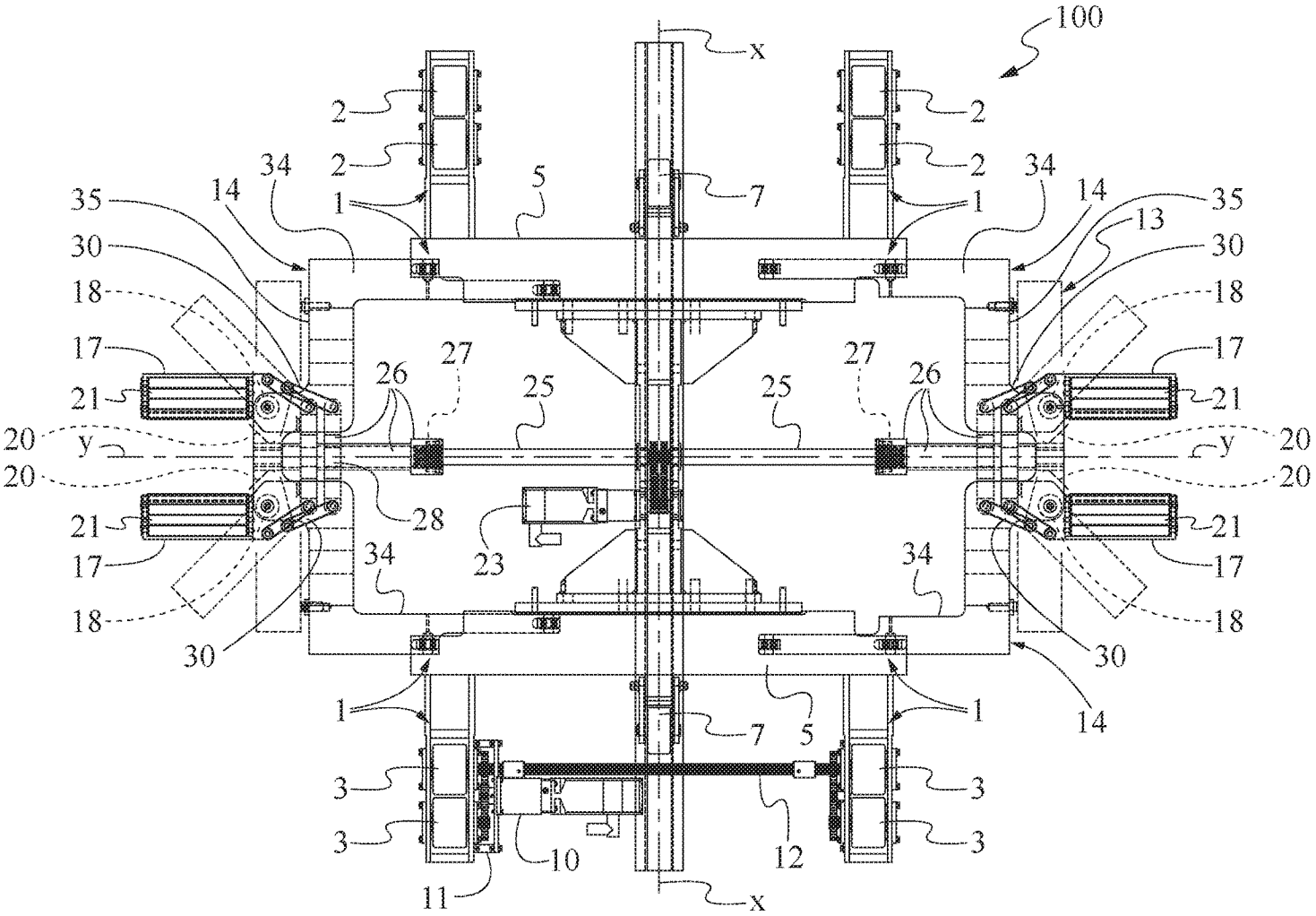
FIG. 2 is a schematic view from above of the transferring carriage of FIG. 1 in a second position with the movable supports being extracted and the clamp elements in the closure position.
Figure 3:
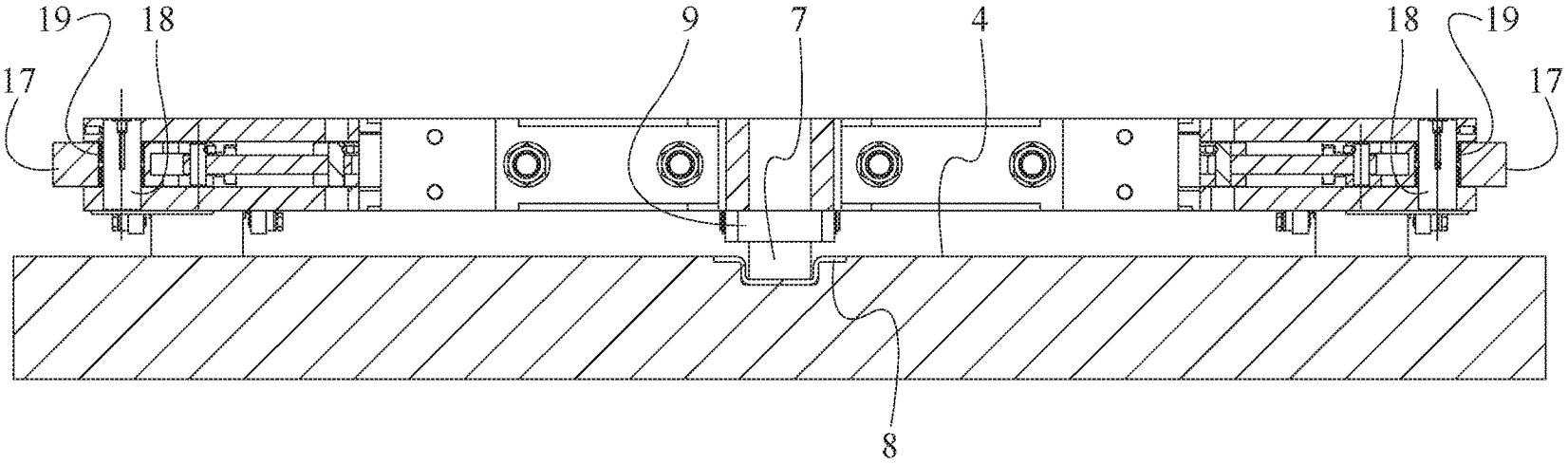
FIG. 3 is a schematic view in section of the transferring carriage of FIG. 1 according to the section line A-A.
Figure 4:
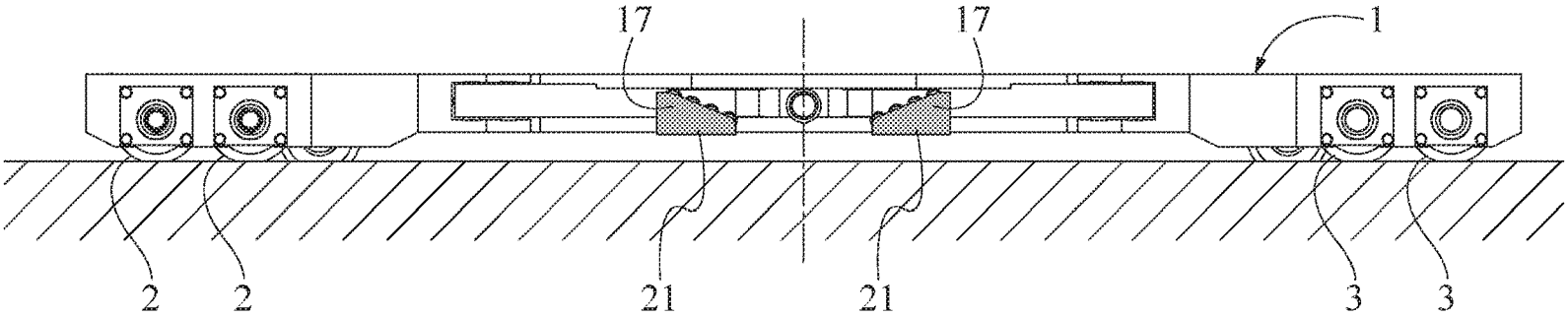
FIG. 4, is a schematic lateral view of the transferring carriage of FIG. 1 with the clamp elements in the closure position.
Figure 5:
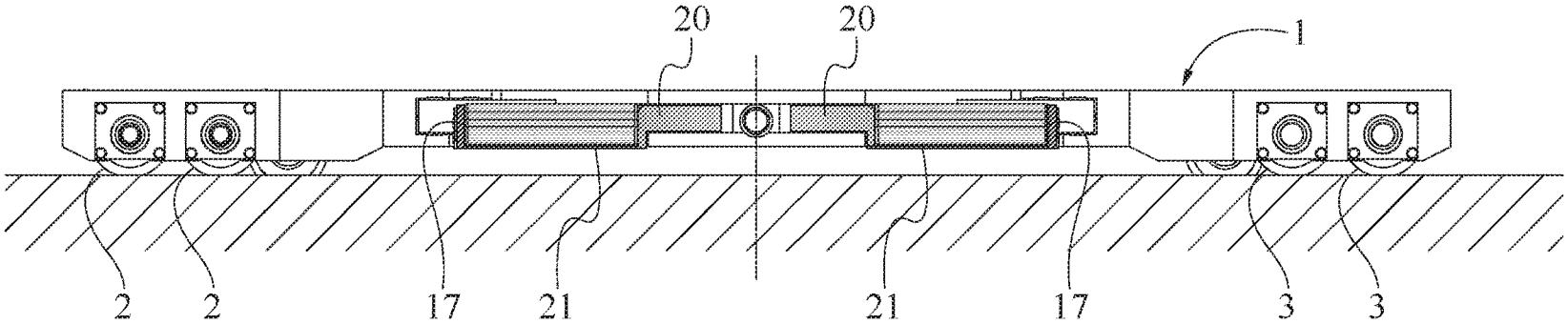
FIG. 5 is a schematic lateral view of the transferring carriage of FIG. 1 with the clamp elements in open position.

The movable supports 14 can translate between a resting closed position, shown in FIG. 1 to an open working position shown in FIG. 2 and vice versa.

More in detail, the two movable supports 14 are opposed with respect to a longitudinal axis X-X of the carriage 100 and can translate with respect to the longitudinal axis of the carriage X-X between a resting closed position, shown in FIG. 1, and an open working position, shown in FIG. 2. The open position being arranged transversally more externally with respect to the closed position.

The open position is not a fixed position that depends by the structure of the device 13, but a position which changes each time, and being determined by the internal transversal distance between the tyres of the of the wheels of an axle of the vehicle to be transported.

The transversal distance inside the tyres of the wheels of an axle of the vehicle to be transported can be measured as the distance in the transversal distance between the two facing surfaces of the two wheels of an axle of the vehicle.

In other words, it changes according of the vehicle to be transported. For performing the centering of the vehicle, each time said open position is determined in such a way that once the vehicle is centered, the longitudinal axis X-X of the carriage 100 coincides with the longitudinal axis of the vehicle to be transported.

Each of the two movable supports 14 supports, in correspondence to one end a couple of clamp elements 17, each clamp element 17 can rotate of about 90° around a pin 18 which is fixed to the movable supports 14.

Each clamp element 17 being constrained to the pin 18 by means of bearings 19.

Always referring to the embodiment shown in the figures, it can be seen as the clamp element 17 is constituted by an arm 21 and by a lip 20 that, when the clamp element 17 is in the open position, slightly protrudes transversally towards outside of the carriage 100.

The lip 20 is associated to the arm 21 and is shaped so as to, when it is pressed against the tyre of a wheel 32 of the vehicle, tends to make the arm 21 rotate and consequently the clamp element 17 itself, from the open position shown with a dashed line in FIG. 2 towards said closed position shown in FIG. 2 with a continuous line.

Preferably, the arm 21 houses of the free rollers 22 arranged on an inclined plane in such a way to force the wheel 32 of the vehicle, that is grasped simultaneously by a couple of clamp elements 17, to raise.

For that purpose, the inclined planes of two clamp elements 17 of the same couple are counterinclined, when the arms 21 of the same couple of clamp elements 17 are in closure position.

The device 13 of centering, raising and keeping of the wheel 32 of a vehicle is capable of performing the raising and the rigid keeping of the two wheels 32 of an axle of the vehicle by means of a single transversal movement towards outside of the carriage of the movable supports 14 and of the couples of clamp elements 17 integral therewith.

In such a way, the frame 1 always rests axially oriented along the longitudinal axis X-X of the carriage 100. This advantageously allows to use the present invention in closed spaces like the modern underground car parks, wherein the carriages are made sliding on guiding rails and for which saving the lateral space necessary for letting the carriages pass is of a fundamental importance. The carriage 100 enjoys greater compactness also in height with respect to the solutions that were protected in the known art, also because the complex and unique motion which is operated by the device 13 of centering, raising and keeping of the wheel rests fixed on a same horizontal plane, fundamentally coinciding with the one of the frame (1) of carriage, and does not change height. The carriage 100 furthermore does not necessitate of a trench, passing under the vehicle by laying on the road plane or the pavement.

In this extent, the transversal motion of the U-shaped movable supports 14 is performed by means of a second geared motor 23 and by the pinions 24 thereof, which make rotate two worm screws 25.

Advantageously, therefore, only two geared motors are present, of which a first geared motor 10—is devoted to translate longitudinally the carriage 100 along the longitudinal axis X-X, while the second—second geared motor 23—is entirely devoted to control of the transversal motion of the movable supports 14.

The geared motors are electrically controlled by a data processing unit that advantageously is configured for driving in sequence first the first geared motor 10 for the positioning in correspondence of the wheels of the vehicle and subsequently for driving the second geared motor 23 for the transversal motion of the movable supports 14.

Referring to the embodiment shown in figure, it can be seen that—of the two worm screws 25—one has right-handed threading, while the other has left-handed threading.

The inverse rotation of the two worm screws 25 moves, preferably symmetrically, two pushing anchors 26 towards the outside or towards the inside of the carriage 100.

Preferably, each pushing anchor 26 is constituted by a cross-head nut 27 and by a quill with crossed crossbeam 28 at whose ends are fixed pins 29 onto which two pushing rod 30 are hinged.

The two pushing rods 30 are hinged at the opposite end of the pins 31 of each couple of clamp elements 17.

The pushing anchors 26 axially move towards inside or outside of the carriage 100 the movable supports 14 and consequently the couples of clamp elements 17 integral therewith.

Moving transversally towards outside, the movable supports 14 bring the the lips 20 to stop against lo tyre of the wheel of the vehicle 32 and when the lips 20 axially push towards outside the tyre of the wheel of the vehicle 32 by triggering the rotation of the clamp elements 17 of each couple and consequently the taking and the raising of the wheel of the vehicle 32.

When the user conducts the vehicle into the entering room for the automatic parking, he leaves the vehicle itself in an area which is specifically delimited. The position of the vehicle axles can be detected using known devices like load cells, photocells, photoelectric cells barriers, laser scanners, cameras or others. Since the carriage 100 according to the present invention can raise two wheels 32 of an axle, the operation of transferring of a vehicle shall be realized by using two carriages 100 according the present invention, arranged in sequence in the longitudinal direction and, eventually, specifically connected each other.

In a first step, each carriage 100 will be positioned, by means of a control of the position and of motion realized with known methods, in such a way to have the own transversal axis coinciding in the neighborhood of the axle of a couple of wheels 32 of the vehicle.

Figure 6:
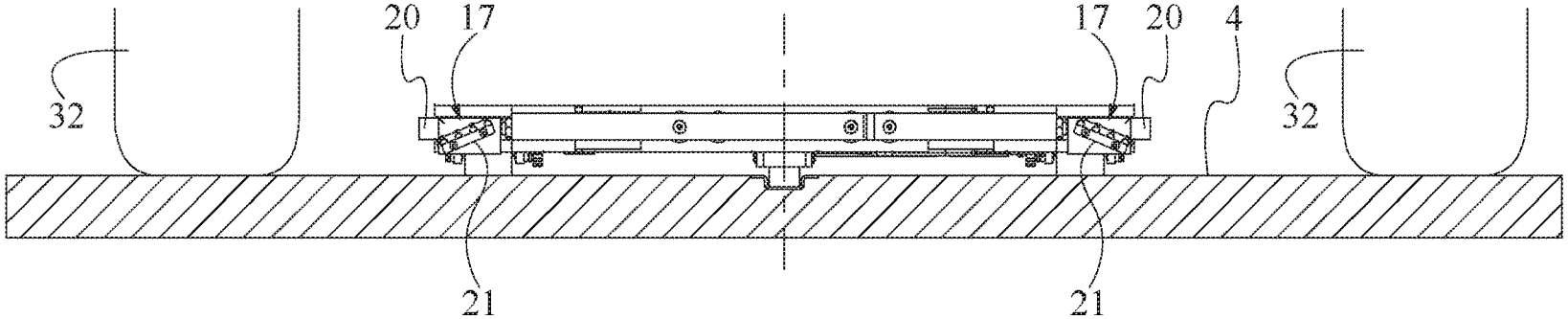
FIGS. 6, 7, 8, 9 show sequential phases of the operations of centering, taking and raising of the wheels of an axle of a vehicle with the carriage according to the present invention.
Figure 7:
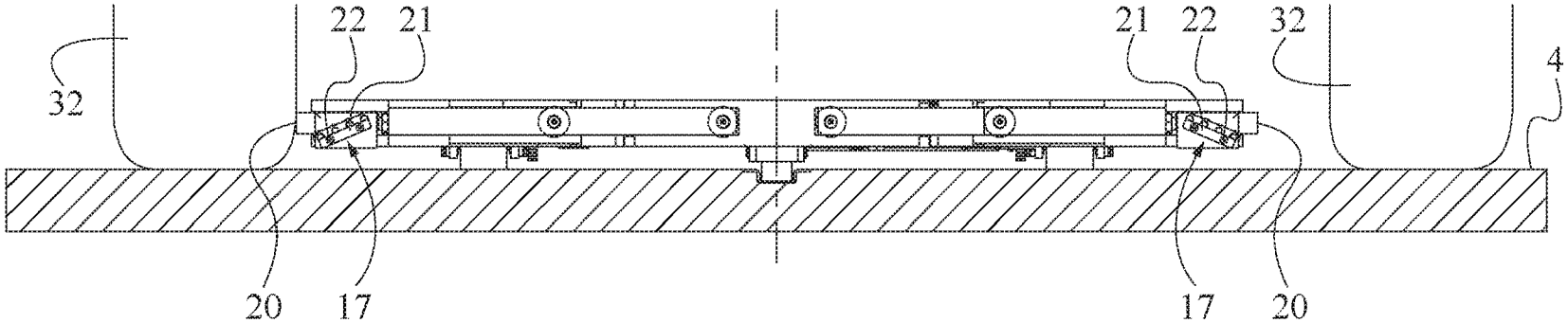

The position of the two wheels 32 of the vehicle, being normally the longitudinal axis of this last not coinciding with the longitudinal axis of the carriage 100, will be such that, as shown in FIG. 6, each wheel will have a distance from the longitudinal axis of the carriage 100 which is different from the other one's distance.

In the FIGS. 6-9 are shown, by way of example and schematically, some phases of centering, raising and keeping of the two wheels 32 of an axle of a vehicle with the carriage 100 yet described.

In detail, in FIG. 6 the carriage 100 is positioned under the vehicle.

At this point, through the symmetrical pushing towards outside of the two devices 13, the operation of centering, raising and keeping of the wheels is started.

Figure 8:
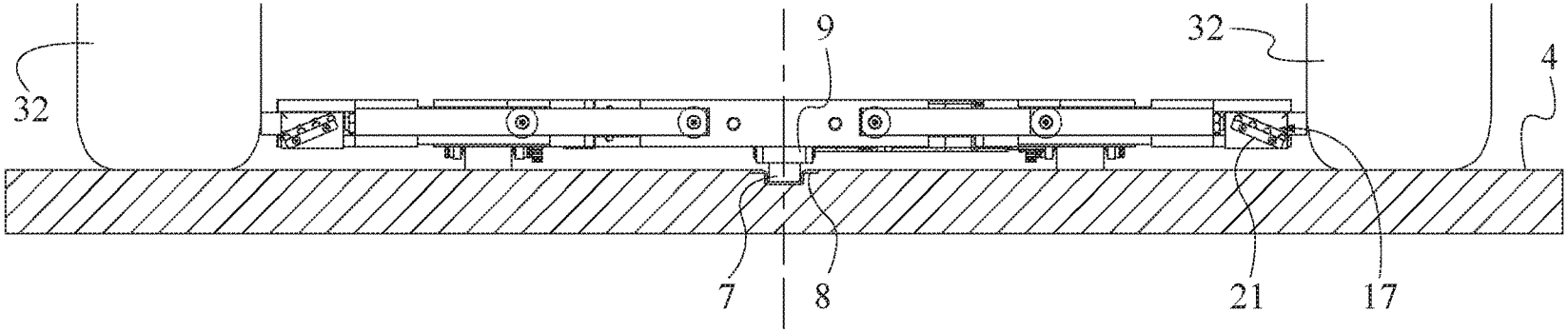

In a second and subsequent phase, one of the two devices 13 of centering, raising and keeping encounters first a wheel 32 (FIG. 7) and, pushing it and exerting on it a transversal force with respect to the longitudinal axis X-X, it moves the wheel up to the moment in which the second device 13 of centering raising and keeping finds the second wheel 32 (FIG. 8).

Not being able to move further the second wheel 32 towards outside, being the transversal internal distance among the wheels 32 fixed, and consequently not being able to move neither the first wheel 32, the devices 13 of centering, raising and keeping actuate, in the continuity of motion of the pushing anchors 26, the rotation movement of the clamp elements 17 of the two couples.

In particular, the rotation movement of the clamp elements 17 of each couple is triggered by the reaction force exerted by the wheels 32 on the lips 20.

Figure 9:
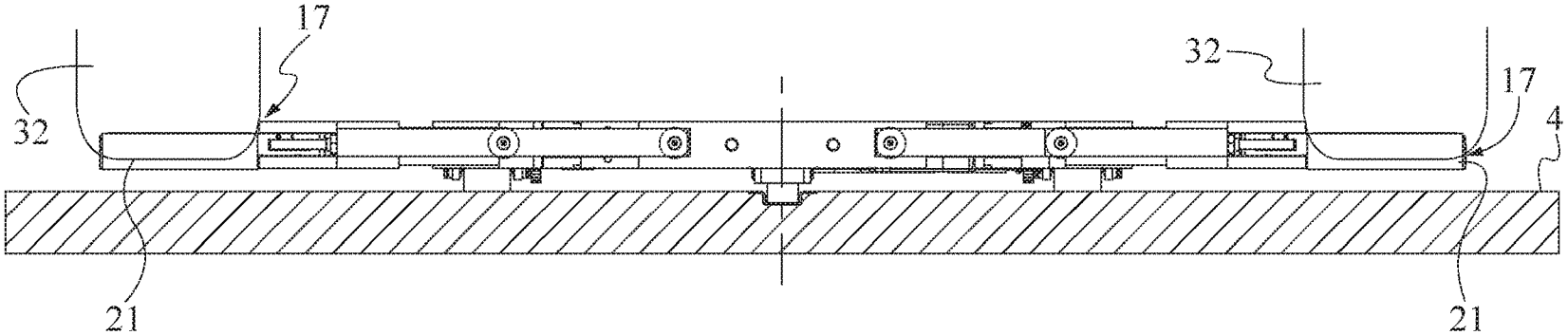

Said reaction force, making the clamp elements 17 slightly rotate around the pins 18, provides that the axis of the pushing rods 30 instead of passing by the axis of the pin 18, around which the clamp elements 17 rotate, moves slightly so as to create a couple that triggers a rotation movement of the clamp elements 17 and that increases always more with the rotatory movement of these last up to obtaining the raising of the wheels 32, as shown in FIG. 9.

The FIG. 9 shows the final position of raising of the two wheels 32 of an axle of the vehicle and the keeping, by means of the final part of the U-shaped movable supports 14 of the wheels 32 against longitudinal movements provoked by the accelerations during the transportation of the vehicle.

The present invention has been described referring to some embodiments.

A plurality of modifications can be brought to the herewith described embodiment, by resting anyway into the scope of protection of the invention, defined by the following claims.

The invention claimed is:

1. A transferring carriage for vehicles for automatic mechanical parking systems, the transferring carriage comprising:

a frame; and a device for centering, raising and keeping of a wheel of an axle of a vehicle, wherein said device is coupled to the frame and comprises:

first clamp elements; and a first movable support, wherein the first clamp elements are supported by the first movable support, wherein said first movable support is translatable in a transverse direction that is substantially perpendicular to a central longitudinal axis, for positioning said first clamp elements in proximity of the wheel of the axle of the vehicle, and wherein the device is configured for performing the centering, the raising and the keeping of the two wheels by a transverse, with respect to the central longitudinal axis, movement towards an outside of the carriage of the movable supports and of the first clamp elements coupled thereto, such that the first clamp elements engage the wheel and pivot together in order to center, raise, and keep the wheel.

2. The transferring carriage according to claim 1, wherein said device further comprises a second movable support, opposed with respect to the longitudinal axis of said carriage first movable support, said first and second movable supports being translatable with respect to the longitudinal axis of said carriage between a resting closed position and an open working position, the first and second movable supports being transversely arranged farther apart in said open position than in said closed position.

3. The transferring carriage according to claim 2, wherein:

said open position varies according to an inner transversal distance between a tire of the wheel and a second tire of a second wheel of the axle of the vehicle to be carried;

said open position is such that, once the vehicle is centered, said longitudinal axis of the carriage coincides with the longitudinal axis of the vehicle.

4. The transferring carriage according to claim 1, wherein:

the first clamp elements comprise a couple of clamp elements that are opposed with respect to the transverse direction of said carriage and rotatable around a rotation axis between a rest position and a closed position in which they are substantially facing one another.

5. The transferring carriage according to claim 4, wherein each first clamp element comprises:

at least an arm comprising at least an inclined plane, said at least an arm being rotatable between an open position and a closed position that is substantially orthogonal to the longitudinal axis of said carriage;

at least a lip functionally connected to said at least an arm and shaped so that when the lip is pressed against a tire of the wheel of a vehicle, the lip urges the arm from said open position of the arm towards said closed position of the arm.

6. The transferring carriage according to the claim 5, wherein each arm comprises a plurality of rollers arranged on said inclined plane, the inclined planes of the first clamp elements being counterinclined, when said at least an arm is in said closed position.

7. The transferring carriage according to claim 1, further comprising a translating assembly of said first movable support, the translating assembly comprising:

at least one worm screw;

at least one geared motor operatively connected to said at least one worm screw for driving a rotation thereof; and at least one pushing anchor.

8. The transferring carriage according to claim 7, wherein the at least one pushing anchor comprises:

at least a nut screw coupled with said at least one worm screw; and at least a quill provided of a crossbeam at whose ends two pushing rods are hinged.

9. The transferring carriage according to claim 8, wherein each pushing rod is hinged at another end, to one of the first clamp elements such that an axis of each pushing rod passes for the rotation axis of each of the first clamp elements when the first clamp elements are in a resting position.

10. The transferring carriage according to claim 9, wherein the at least one worm screw comprises two worm screws rotated by said geared motor, one of said two worm screws having a right-handed thread, whereas the other has a left-handed thread, the opposed rotation of the two worm screws moves said two pushing anchors axially to an outside or an inside of said carriage.

11. The transferring carriage according to claim 1, wherein said frame comprises at least a crossbeam in which a movable supporting element is configured to slide.

12. The transferring carriage according to claim 1, wherein each movable supporting element comprises two tines arranged on the outside of a crossbar, each tine sliding in a crossbar of said frame.

13. The transferring carriage of vehicles for systems of automatic mechanic parking systems comprising two transferring carriages according to claim 1, wherein the two transferring carriages are arranged one after another along a longitudinal direction.

14. The transferring carriage according to claim 1, wherein the device of centering, raising and keeping of the wheel lines on a horizontal plane that is parallel to or coplanar with the one of the frame of the carriage.

15. A transferring carriage, comprising:

a frame including one or more longitudinally-extending crossbeams;

a first movable support that is movable in a transverse direction that is substantially perpendicular to the crossbeams;

a first driver coupled to the frame and the first movable support, wherein the first driver is configured to apply a first force in the transverse direction on the first movable support;

a first pair of clamp elements pivotally coupled to the first movable support, wherein the first movable support is configured to move the first pair of clamp elements toward a tire of a vehicle, and wherein the first pair of clamp elements are configured to pivot toward one another so as to raise and support the tire by engagement with the tire and continued application of transversely-oriented force on the first movable support;

a second movable support that is movable in the transverse direction;

a second driver coupled to the frame and the second movable support, wherein the second driver is configured to apply a second force in the transverse direction on the second movable support;

a second pair of clamp elements pivotally coupled to the second movable support, wherein the second movable support is configured to slide the second pair of clamp elements toward a second tire of the vehicle, wherein the second pair of clamp elements are configured to pivot toward one another so as to raise and support the second tire by engagement with the second tire and continued application of the second force, and wherein the application of the first force, the second force, or both causes the first and second tires to be moved substantially equidistant from a longitudinal centerline of the frame.

* * * * *